United States Patent [19]

Tietz

[11] 4,222,252

[45] Sep. 16, 1980

[54] CYLINDER LOCK WITH A LOCK PICKING IMPEDIMENT

[75] Inventor: Werner Tietz, Berlin, Fed. Rep. of Germany

[73] Assignee: Zeiss Ikon AG Goerzwerk, Fed. Rep. of Germany

[21] Appl. No.: 930,391

[22] Filed: Aug. 2, 1978

[51] Int. Cl.[2] ..... E05B 15/14; E05B 29/04

[52] U.S. Cl. ..... 70/364 A; 70/378; 70/419

[58] Field of Search ..... 70/364 R, 364 A, 378, 70/419, 421

[56] References Cited

U.S. PATENT DOCUMENTS

| | | | |
|---|---|---|---|
| 1,965,889 | 7/1934 | Fitzgerald | 70/419 |
| 2,003,086 | 5/1935 | Liss | 70/421 |
| 2,021,185 | 11/1935 | Hurd | 70/419 |
| 2,426,104 | 8/1947 | Johnstone | 70/421 |
| 3,479,849 | 11/1969 | Check | 70/419 |
| 3,495,330 | 7/1970 | Bauer | |

FOREIGN PATENT DOCUMENTS 139755 5/1930 Switzerland

*Primary Examiner*—Robert L. Wolfe

*Attorney, Agent, or Firm*—Hill, Van Santen, Steadman, Chiara & Simpson

[57] ABSTRACT

An improved cylinder lock which is very difficult to pick has at least one cylinder pin into which a set of shallow grooves has been cut as well as a deeper notch at one end of the pin. A boring is made in the cylinder at an angle to the boring of the cylinder pin and into which is placed an appropriately sized obstructing pin. The obstructing pin is free to drop into a recess made in the lock housing when the cylinder is locked. The process of attempting to pick the lock by rotating the cylinder slightly results in the obstructing pin sliding along the side of the V-shaped recess in the housing and thereby moving toward and engaging the notches in the body of the cylinder pin preventing unauthorized movement of the cylinder pin which would render the associated locking pin inoperative. When a legitimate key has been inserted into the cylinder, the cylinder pin moves to its fully unlocked position before the cylinder rotation is initiated. Upon initiation of the cylinder rotation, the obstructing pin slides up the V-shaped recess in the cylinder lock and the end thereof moves into a deeper V-shaped groove at one end of the cylinder pin, which has already achieved its unlocked position, thereby permitting the cylinder lock to freely rotate. Since the notches in the cylinder pin disengage the obstructing pin when the attempted illegitimate rotation has been ceased, the lock may then be unlocked in a normal fashion using a proper key.

10 Claims, 2 Drawing Figures

CYLINDER LOCK WITH A LOCK PICKING IMPEDIMENT

BACKGROUND OF THE INVENTION

1. Field of the Invention

The field of the invention is that of locks and more particularly the improvement of the security of cylinder locks.

2. Background of the Invention

The procedure of attempting to pick a cylinder lock involves a process whereby tools are introduced into the key channel whose purpose it is to adjust the cylinder pins or tumbler pins and at the same time exert a torsional or twisting moment on the cylinder itself.

The adjusting tool inserted into the key channel has the purpose of attempting to shift the tumbler or cylinder pins which are biased by internal springs to positions which correspond to their unlocked positions thus enabling the rotary cylinder to be turned.

The second tool has the purpose of applying a torsional or twisting moment to the cylinder core thereby clamping the cylinder and locking pins so that as each cylinder and corresponding locking pin is pushed to its unlocked position, the spring biased locking pin is clamped tight and is not allowed to return to its locking position. Thus, the cylinder pins may be unlocked one at a time until all have been released thereby improperly unlocking the lock.

U.S. Pat. No. 3,195,330, as well as Swiss Pat. No. 139,744 disclose rotary cylinder locks containing tumbler pins with corresponding recesses into which an obstructing element may fall if an attempt is made to pick the lock. In the U.S. patent, a core pin is disclosed with a recess into which an obstructing pin may be dropped permanently if an attempt is made to pick the lock. The disadvantage that must be accepted with this prior art device is that the lock becomes useless unless disassembled once the obstructing pin has dropped into position.

In the above enumerated Swiss Patent, auxiliary tumblers are used, into whose recesses locking or obstructing pins may drop, if a non-fitting skeleton key is used and the cylinder is rotated one step. With this apparatus it will not be possible with a skeleton key to bring all tumblers into the unlocked position. There will still remain gaps into which the auxiliary tumblers may drop and be able to latch the lock permanently closed until disassembled.

There has been a need for a lock which impedes picking but which may thereafter be utilized with a legitimate key without first disassembling the lock and resetting the obstruction pins.

BRIEF SUMMARY OF THE INVENTION

The invention makes picking of a cylinder lock very difficult by incorporating a simple and effective mechanism. A standard cylinder lock with spring loaded tumblers has one of the tumblers or core pins modified so as to include an engaging means integrally affixed to the pin. For example grooves may be cut into the body of the core pin. At the end of the modified cylinder or core pin is a larger V-shaped end region or groove, the two sides of which come together at essentially a ninety degree angle. A second boring is made at an angle to the boring that the cylinder pin resides in and which intersects the cylinder pin boring. A V-shaped recess is made in the cylinder lock housing which is opposite the additional boring when the cylinder is in the locked position. An obstructing pin has a first end which is curved and which corresponds to a curve in the bottom of the recess in the lock housing is installed in the additional boring capable of limited radial movement. The obstructing pin has a length such when the cylinder is in the locked position, the key may be inserted to slide the cylinder pin past an end of the obstructing pin. If an improper means is attempted to be used to move the cylinder pin and also rotate the cylinder, the curved end of the obstructing pin will slide along the recess in the housing resulting in a radial movement of the obstructing pin. This radial movement causes a second end of the obstructing pin to engage the engaging means on the body of the cylinder pin thereby preventing its motion, and thereby preventing the cylinder from being unlocked and rotated.

It is a feature of this invention that the engaging means on the cylinder pin is a releasable engaging means. Once an improper attempt to open the lock has ceased, a legitimate key may be inserted to slide the cylinder pin past the obstruction pin thereby releasing the cylinder.

It is a further feature of the invention that the second end of the obstructing pin which intersects the body of the cylinder pin at the V-shaped end region corresponds to the shape of the V-shaped end region.

In a further embodiment of the invention, the engaging means on the body of the cylinder pin consists of shallow furrows. Alternately, a roughening of the body of the cylinder pin or a knurling of the body of the cylinder pin will accomplish the same result.

DETAILED DESCRIPTION OF THE PREFERRED EMBODIMENTS

Figure 1:
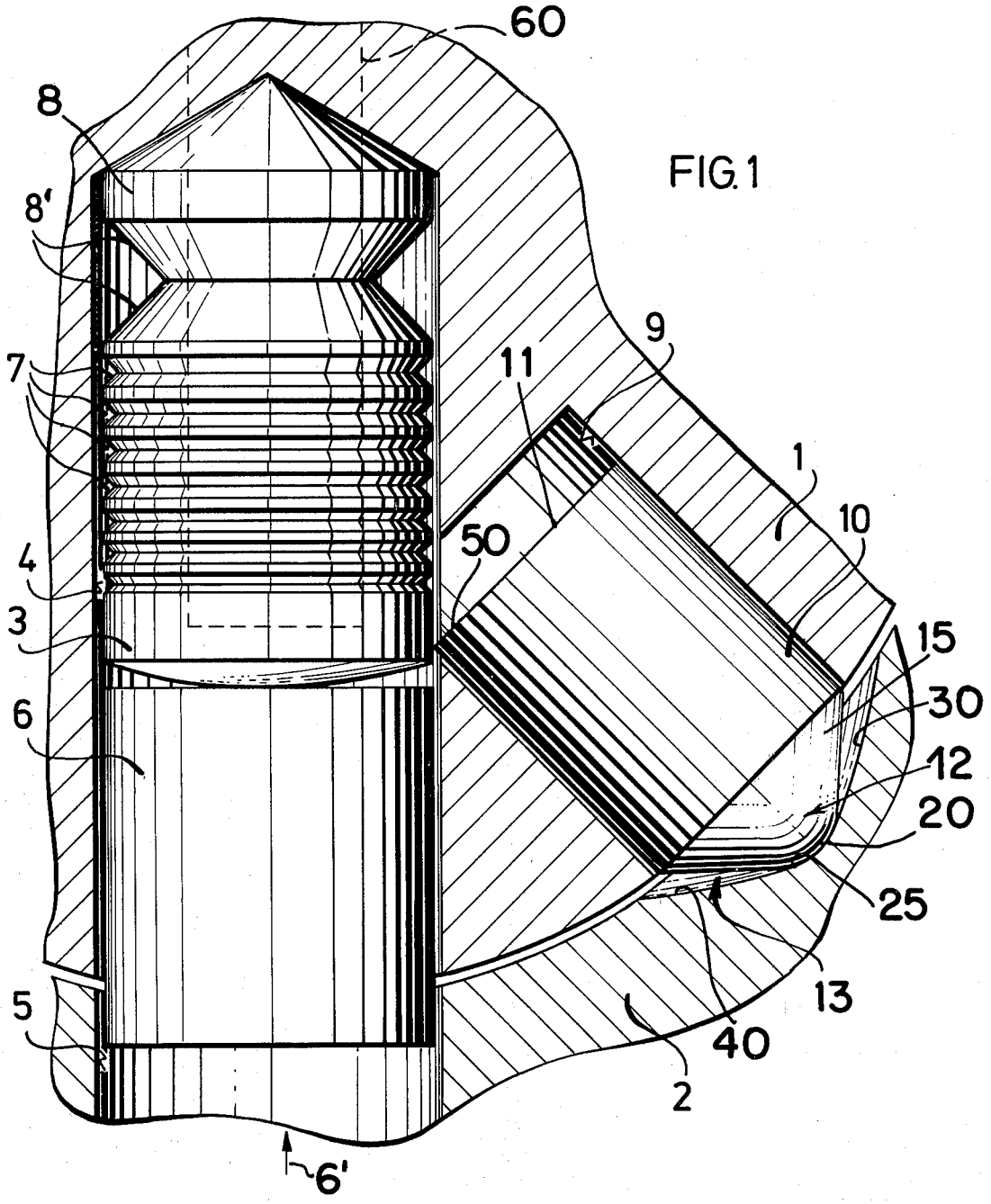
FIG. 1 is a partial enlarged pictorial section of a typical cylinder pin and corresponding locking pin of a cylinder lock, with the obstructing pin of the present invention, in the locked position.

Though the principle of the present invention as disclosed is embodied in an apparatus to impede the picking of cylinder locks, the principle is usable in other combinations. By way of exemplary disclosure of the best mode of practicing the invention and not by way of limitation, there is shown generally in FIG. 1 a cylinder lock incorporating the inventive anti-picking apparatus.

A rotary cylinder 1 is surrounded by a housing 2. A core pin 3 is positioned in a bore 4 in the cylinder 1. In the obstructing position shown in FIG. 1 of the lock, as well as in the equalization position shown in FIG. 2, there is flush with the cylinder bore 4, a housing bore 5, in which a pertaining housing pin 6 is positioned. The locking pin 6 is biased in a direction 6' by a conventional compression spring which is not indicated.

A series of shallow circumferential grooves 7 are located near the center of the pin 7. Near an end 8 of the pin 3 is a deeper circumferential groove 8'. A second cylinder bore 9 is located at an angle with respect to the bore 4 and contains an obstructing pin 10. The pin 10 has a flat end 11 adjacent to the core pin 3 and a bullet-shaped end 12.

A recess 13 is located in the housing 2 opposite the boring 9, into which the end 12 obstructing pin 10 may withdraw. The pin 10 withdraws into the recess 13 whenever the bore 4 is aligned with the bore 5. The end 12 of the pin 10 has a tapered surface 15 which terminates in a curved end 20 of a predetermined radius which corresponds to a curved surface 25 at the bottom of the recess 13.

As indicated in FIG. 1, when the bore 4 is aligned with the bore 5, the cylinder pin 3 is free to slide past the end 11 of the obstruction pin 10.

Any misalignment of the bore 4 with respect to the bore 5 causes the end 20 of the pin 10 to slide along a surface 30 or a surface 40 which drives the pin 10 within the boring 9 toward the cylinder pin 3. When the pin 10 has moved toward the pin 3, an edge 50 of the surface 11 will engage one of the shallow slots 7 thereby locking the pin 3 which in turn locks the pin 6 thereby rendering the cylinder 1 immovable. As the alignment of the bores 4 and 5 is restored, the edge 50 disengages from the slot 7 thereby releasing the pin 3.

It can be seen that through the inventive solution it is difficult or impossible in the limited time available for picking the lock, to open such a lock improperly. As a further impedance not only one but several of the core pins can be provided with the grooves or furrows 7 and with related obstructing pins. It should be pointed out that the core pins of a lock are set to be different in length, and that it lies within the scope of the invention, to provide these pins with grooves of varying number and different arrangements.

The pin 10 only permits the cylinder 1 to turn when a proper key has been inserted into a key channel 60. With respect to FIG. 2, a legitimate key will move the cylinder radially pin 3 to an edge 70 of the cylinder 1. An end surface 75 of the pin 3 will press against the housing pin 6 thereby driving it against the spring and moving the pin 6 out of the bore 4. This movement of the pins 3 and 6 under the effect of the key is accomplished without rotating the cylinder 1. Once the pin 6 has been fully displaced out of the bore 4, the cylinder 1 is free to rotate. If the cylinder 1 is rotated in a direction 85, the end 20 of the pin 10 slides along the surface 30 of the recess 13 thereby causing the obstruction pin 10 to move toward the cylinder pin 3. As the obstruction pin 10 moves toward the pin 3, the edge 50 starts to engage the larger, V-shaped slot 8' at the end 8 of the pin 3. When the cylinder 1 has rotated far enough, in the direction 85, the rounded nose 20 of the pin 10 will bear on an interior surface 87 of the housing 2. In this fully retracted position, the edge 50 of the pin 10 is adjacent to a first surface 80 of the slot 8' and a rear side section 90 of the pin 10 is positioned adjacent to a second surface 100 of the slot 8'. The two surfaces 80 and 100 are substantially at a right angle to one another.

Figure 2:
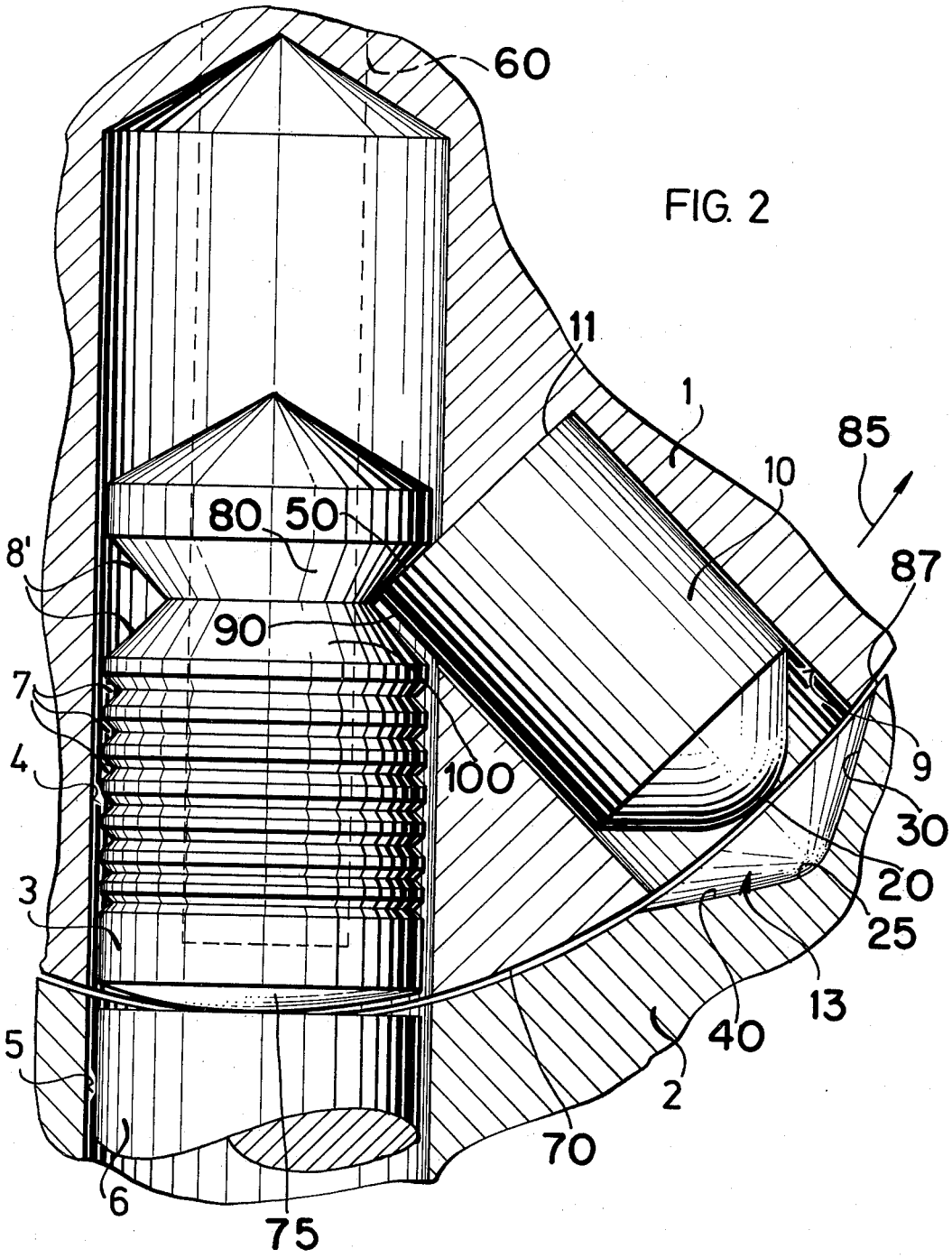
FIG. 2 is a partial enlarged pictorial section of a typical cylinder pin and corresponding locking pin of a cylinder lock, with the obstructing pin of the present invention, in the unlocked position.

It should be noted that the cylinder pin 3 is only permitted to slide past the edge 50 of the obstruction pin 10 when the bores 4 and 5 are substantially aligned. Also, before the end 11 obstruction pin 10 can move into the slot 8', the cylinder pin 3 must have been substantially moved to its unlocked position as indicated in FIG. 2.

The nose 20 of the pin 10 is rounded and corresponds to the radius of the rounded surface 25 so that the pin 10 can move along either the surface 30 or the surface 40 depending on whether the cylinder 1 is attempting to rotate in the direction 85 or opposite to the direction 85.

While the cylinder pin 3 has been shown with shallow grooves 7, it will be understood that my invention includes any means for engaging integrally affixed to the pin 3 against which the edges 5 or 90 of the pin 10 may bear and thereby inhibit motion of the cylinder pin 3.

It should also be noted that my invention is usable a multiplicity of times. Namely, because the obstruction pin 10 has once blocked movement of the cylinder pin 3 does not render the lock inoperative with respect to the proper key. It will also be understood that various lengths of the pin 10 may be used with corresponding cylinder pins 3. A multiplicity of pins such as the obstruction pin 10 may be used in a multiple cylinder lock with one or more obstruction pins associated with some or all of the cylinder pins of the lock.

Although various modifications might be suggested by those skilled in the art, it should be understood that I wish to embody within the scope of the patent warranted hereon all such modifications as reasonably and properly come within the scope of my contribution to the art.

I claim as my invention:

1. A cylinder lock having a lock housing with a cylinder, adapted to accept a key, rotatably mounted in the housing; the cylinder having at least one transverse boring corresponding to a boring in the housing with a cylinder pin disposed in the transverse boring and a spring biased locking pin disposed within the housing boring biased so that the locking pin is driven toward the cylinder and oriented so that the locking pin can enter the transverse boring, abutting an end of the cylinder pin, and thereby lock the cylinder from rotary movement; the cylinder pin being radially displaceable by a key to an unlocked position and operative to drive the locking pin out of the cylinder boring thereby unlocking the cylinder; the improvement comprising:

engaging means integrally affixed to the cylinder pin in a central region thereof with a spacing notch located between an interior end of said cylinder pin and said central region;

a second boring in the cylinder at an acute angle to the transverse boring and intersecting the transverse boring near a mid-region thereof;

a tapered recess in said housing adjacent to said second boring when said cylinder is locked by the locking pin;

an obstruction pin disposed in said second boring having a rounded first end adjacent said tapered recess and a planar second end substantially perpendicular to said obstruction pin and adjacent said engaging means;

only said rounded first end of said obstruction pin cooperating with said tapered recess so as to move said obstruction pin axially inwardly, with respect to said second boring, when said cylinder is rotated with said planar second end operable to blockingly engage said engaging means to block rotation of said cylinder if said cylinder pin has not been moved to said unlocked position, and operable to move adjacent said spacing notch to permit rotation of said cylinder if said cylinder pin has been moved to said unlocked position.

2. The cylinder lock according to claim 1 wherein said means for engaging comprises:

at least one circumferential slot selectively located on said cylinder pin.

3. The improved cylinder lock according to claim 2 wherein said first end of said obstruction pin comprises a conical member affixed to said obstruction pin terminating with a selected radius.

4. The cylinder lock according to claim 1 wherein said engaging means comprises:

a plurality of selectively located circumferential slots.

5. A cylinder lock having a lock housing with a cylinder adapted to accept a key and being rotatably mounted in the housing;

a cylinder having at least one transverse boring corresponding to a boring in the housing with a cylinder pin disposed in the transverse boring and a spring biased locking pin disposed within the housing boring biased so that the locking pin is driven toward the cylinder and oriented so that the locking pin can enter the transverse boring, abutting an end of the cylinder pin, and thereby lock the cylinder from rotary movement;

the cylinder pin being radially displaceable by a key and operative to drive the locking pin out of the cylinder boring thereby unlocking the cylinder;

the improvement comprising:

a plurality of spaced circumferential slots selectively located on the cylinder pin;

a second boring in the cylinder disposed at an acute angle to and intersecting said transverse boring;

tapered recess of selected shape selectively located, with respect to the second boring, in the housing;

an obstruction pin in said second boring capable of limited movement in said second boring;

whereby if said cylinder is rotated so as to jam the locking pin, said obstruction pin slidingly engages said tapered recess and moves inwardly due only to said sliding engagement and a first end of said obstruction pin engages one member of said plurality, of spaced circumferential slots blocking any radial movement by said cylinder pin.

6. The improved cylinder lock according to claim 5 wherein said cylinder pin has a shaped end region whereby when a legitimate key radially displaces said cylinder pin to unlock the lock, and said cylinder is slightly rotated, said obstruction pin cooperates with said tapered recess to move axially inward with respect to said second boring and said shaped end region receives said first end of said obstruction pin permitting said obstruction pin to move inwardly in said second boring a selected distance thereby allowing said cylinder to rotate.

7. The improved cylinder lock according to claim 6 wherein said obstruction pin has a second, tapered end terminating in a curved surface that slidingly engages said tapered recess and where said tapered recess has a substantially V-shaped cross-section terminating in a curved surface compatible with said curved surface of said second end of said obstruction pin.

8. An improved cylinder lock having a lock housing with a cylinder adapted to accept a key and being rotatably mounted in the housing;

the cylinder having at least one transverse boring corresponding to a boring in the housing with a cylinder pin disposed in the transverse boring and a spring biased locking pin disposed within the housing boring biased so that the locking pin is driven toward the cylinder and oriented so that the locking pin can enter the transverse boring, abutting and end of the cylinder pin, and thereby lock the cylinder from rotary movement;

the cylinder pin being radially displaceable by a key and operative to drive the locking pin out of the cylinder boring thereby unlocking the cylinder;

the improvement comprising:

the cylinder pin having a plurality of spaced circumferential slots thereon;

a second boring in the cylinder disposed at an angle to and intersecting said transverse boring;

a recess of selected shape selectively located with respect to the boring in the housing;

an obstruction pin in said second boring capable of limited axial movement in said second boring;

whereby if said cylinder is rotated so as to jam the locking pin, said obstruction pin slidingly engages said recess and moves axially inwardly in said second boring and a first end of said obstruction pin engages one member of said plurality, of spaced circumferential slots blocking any radial movement by said cylinder pin;

wherein said cylinder pin has a shaped end region whereby when a legitimate key radially displaces said cylinder pin to unlock the lock, said shaped end region is operative to receive said first end of said obstruction pin permitting said obstruction pin to move radially allowing said cylinder to rotate; and wherein said first end of said obstruction pin comprises a planar surface transversely oriented with respect to said obstruction pin.

9. The improved cylinder lock according to claim 1 wherein said engaging means comprises a frictional surface affixed to said cylinder pin having a selected coefficient of friction.

10. A cylinder lock having a housing with a cylinder rotatably mounted therein, at least one transverse radial boring in the cylinder with an adjacent boring extending into the housing of the cylinder when the cylinder is in a first angular position, with a cylinder pin in the transverse cylinder boring capable of limited axial movement in that cylinder, a locking pin in the boring in the housing adjacent an exterior end of said cylinder pin, and capable of extending into the cylinder boring to prevent rotation thereof but movable outwardly from the cylinder boring under the urging of the cylinder pin thereby permitting the cylinder to rotate, the improvement comprising:

a plurality of circumferential grooves in a mid-section of the cylinder pin and a V-shaped spacing region near an interior end of the cylinder pin;

a second boring in the cylinder at an acute angle to the transverse radial boring and intersecting the transverse boring at a mid-section thereof; pl a tapered circular recess in the housing, of a selected depth, terminating in a rounded bottom surface having a selected curvature;

an auxiliary locking pin located in said second boring and capable of limited axial movement with respect to said second boring;

an auxiliary locking pin having a first end located adjacent said cylinder pin and forming a selected angle with a cylindrical body portion of said locking pin and having further a second, outwardly extending, curved end adjacent said circular tapered recess;

only said recess and said second end of said auxiliary locking pin cooperating to drive said locking pin inward axially, with respect to said second boring, when said cylinder rotates a selected amount so that an edge of said first end of said locking pin blockingly engages a member of said plurality of circumferential grooves thereby blocking movement of said cylinder pin when said cylinder pin has not been positioned so as to unlock the cylinder, and, so that said first end of said locking pin slides adjacent said V-shaped spacing region when said cylinder pin has been positioned to unlock said cylinder.

* * * * *